US005640794A

United States Patent [19]

Gardner et al.

[11] Patent Number: 5,640,794

[45] Date of Patent: Jun. 24, 1997

[54] FIRE CONTROL MECHANISM FOR AN AUTOMATIC PISTOL

[75] Inventors: Michael R. Gardner, Summerville; Edward P. Schmitter, Blythewood; Gary A. Sniezak, Columbia; Kevin R. Langevin, Camden; Jean-Pierre Reconnu, Columbia, all of S.C.

[73] Assignee: FN Manufacturing, Inc., Columbia, S.C.

[21] Appl. No.: 498,758

[22] Filed: Jul. 7, 1995

[51] Int. Cl.[6] ..... F41A 19/31; F41A 19/38

[52] U.S. Cl. ..... 42/69.02

[58] Field of Search ..... 42/69.02, 69.01, 42/69.03; 89/147

[56] References Cited

U.S. PATENT DOCUMENTS

| | | | |
|---|---|---|---|
| 580,925 | 4/1897 | Browning | 89/145 |
| 621,747 | 3/1899 | Browning . | |
| 929,491 | 7/1909 | Reifgraber | 89/148 |
| 930,710 | 8/1909 | Wiles | 42/7 |
| 970,645 | 9/1910 | Rosier . | |
| 1,081,761 | 12/1913 | Mauser | 89/145 |
| 1,234,961 | 7/1917 | Tansley | 89/145 |
| 1,290,855 | 1/1919 | Wesson | 89/144 |
| 1,486,497 | 3/1924 | Schmeisser . | |
| 1,835,715 | 12/1931 | McCoy | 42/69.03 |
| 2,296,998 | 9/1942 | Koehler | 42/3 |
| 2,346,484 | 4/1944 | Gradle | 42/69.02 |
| 2,551,370 | 5/1951 | Gartner | 42/69.02 |
| 3,167,877 | 2/1965 | Jungeling | 42/69.03 |
| 3,183,616 | 5/1965 | Gandy | 42/69.02 |
| 3,566,745 | 3/1971 | Jauch et al. | 89/187 |
| 3,641,694 | 2/1972 | Seidel et al. | 42/722 |
| 3,678,800 | 7/1972 | Seidel et al. | 89/147 |
| 3,683,537 | 8/1972 | Silva | 42/69 R |
| 3,696,706 | 10/1972 | Seidel et al. | 89/196 |
| 3,722,358 | 3/1973 | Seecamp | 89/147 |
| 3,760,522 | 9/1973 | Guhring | 42/69 B |
| 3,786,589 | 1/1974 | Kaltmann | 42/78 |
| 3,861,273 | 1/1975 | Seidel et al. | 89/129 B |
| 3,919,781 | 11/1975 | Chaba | 33/233 |
| 4,078,327 | 3/1978 | Moller et al. | 42/71 R |
| 4,132,023 | 1/1979 | Weldle | 42/7 |
| 4,222,308 | 9/1980 | Arnett | 89/163 |
| 4,236,337 | 12/1980 | Beretta | 42/7 |
| 4,265,161 | 5/1981 | Beretta | 89/129 B |
| 4,271,623 | 6/1981 | Beretta | 42/72 |
| 4,282,795 | 8/1981 | Beretta | 89/148 |
| 4,306,487 | 12/1981 | Beretta | 89/148 |
| 4,348,941 | 9/1982 | Ketterer et al. . | |

(List continued on next page.)

FOREIGN PATENT DOCUMENTS

| | | | |
|---|---|---|---|
| 138112 | 6/1934 | Austria | 42/69.02 |
| 357441 | 12/1905 | France | 89/196 |
| 606786 | 6/1926 | France | 89/196 |
| 312845 | 4/1918 | Germany | 42/7 |
| 361175 | 10/1922 | Germany | 42/7 |
| 2517002 | 10/1976 | Germany | 42/69.03 |
| 6955 | 3/1914 | United Kingdom | 89/196 |

*Primary Examiner*—Stephen M. Johnson
*Attorney, Agent, or Firm*—Michael A. Mann, P.A.

[57] ABSTRACT

A fire control system for a semiautomatic, double-action only pistol includes a sear carried at the free end of a cantilevered spring. As in other pistols, the sear engages a striker to load it against a striker spring until it is released to fire a chambered round. In the present invention, the cantilevered spring urges the sear forward and upward, against the rearward movement of the sear as a result of the pulling of a trigger operating through a trigger arm, and restores the sear after release of the striker. The cantilevered spring is preferably a spring with a torsion spring on each end. One torsion spring operates against the frame to cantilever the spring body; the other torsion spring, supporting the sear, operates on it to urge it forward. The sear and the striker lay in the same plane. Therefore, the sear has a second cam surface that engages the striker leg when the trigger is released, urging the sear downward as the striker passes over it to set up the sear for loading the striker the next time the trigger is pulled.

17 Claims, 3 Drawing Sheets

U.S. PATENT DOCUMENTS

| | | | |
|---|---|---|---|
| 4,359,834 | 11/1982 | Beretta | 42/94 |
| 4,388,773 | 6/1983 | Beretta | 42/75 B |
| 4,454,673 | 6/1984 | Meidel | 42/70 F |
| 4,502,237 | 3/1985 | Krogh | 42/50 |
| 4,512,236 | 4/1985 | Thevis et al. | 89/128 |
| 4,523,509 | 6/1985 | Thevis et al. | 89/129.02 |
| 4,539,889 | 9/1985 | Glock | 89/147 |
| 4,575,963 | 3/1986 | Ruger et al. | 42/70 F |
| 4,577,430 | 3/1986 | Ruger et al. | 42/69 R |
| 4,587,756 | 5/1986 | Jakubaschk et al. | 42/50 |
| 4,590,697 | 5/1986 | Ruger et al. | 42/70 F |
| 4,625,443 | 12/1986 | Beretta | 42/42.03 |
| 4,625,445 | 12/1986 | Ruger | 42/71.02 |
| 4,627,184 | 12/1986 | Ruger et al. | 42/25 |
| 4,635,530 | 1/1987 | Weldle | 89/159 |
| 4,681,020 | 7/1987 | Polanecky | 89/138 |
| 4,707,942 | 11/1987 | Peters | 42/77 |
| 4,759,885 | 7/1988 | Kurtz | 264/3.1 |
| 4,768,302 | 9/1988 | Beretta | 42/70.08 |
| 4,771,562 | 9/1988 | Ruger | 42/71.02 |
| 4,823,671 | 4/1989 | Buryta | 89/1.4 |
| 4,825,744 | 5/1989 | Glock | 89/145 |
| 4,833,811 | 5/1989 | Wilkinson | 42/70.08 |
| 4,893,546 | 1/1990 | Glock | 89/145 |
| 4,899,476 | 2/1990 | Hindle . | |
| 4,910,903 | 3/1990 | Senfter | 42/69.02 |
| 4,916,843 | 4/1990 | Beretta | 42/70.01 |
| 4,930,400 | 6/1990 | Brandl et al. | 89/34 |
| 4,934,081 | 6/1990 | Mooney | 42/62 |
| 4,977,815 | 12/1990 | Stephens | 89/180 |
| 4,984,504 | 1/1991 | Beretta | 89/163 |
| 5,014,456 | 5/1991 | Kurtz et al. | 42/50 |
| 5,024,016 | 6/1991 | Smith | 42/25 |
| 5,050,480 | 9/1991 | Knight, Jr. et al. | 89/147 |
| 5,060,555 | 10/1991 | Sater et al. | 89/196 |
| 5,086,579 | 2/1992 | Flatley et al. | 42/70.08 |
| 5,129,172 | 7/1992 | Brennan | 42/25 |
| 5,159,137 | 10/1992 | Brennan | 42/75.02 |
| 5,275,084 | 1/1994 | Ruger | 89/196 |
| 5,309,815 | 5/1994 | Moller et al. | 89/163 |
| 5,386,659 | 2/1995 | Vaid et al. | 42/69.02 |

10
12
14
16
18
20
22
24
26
28
30
34
38
40
42
44
46
50
54
56
60

FIG 2
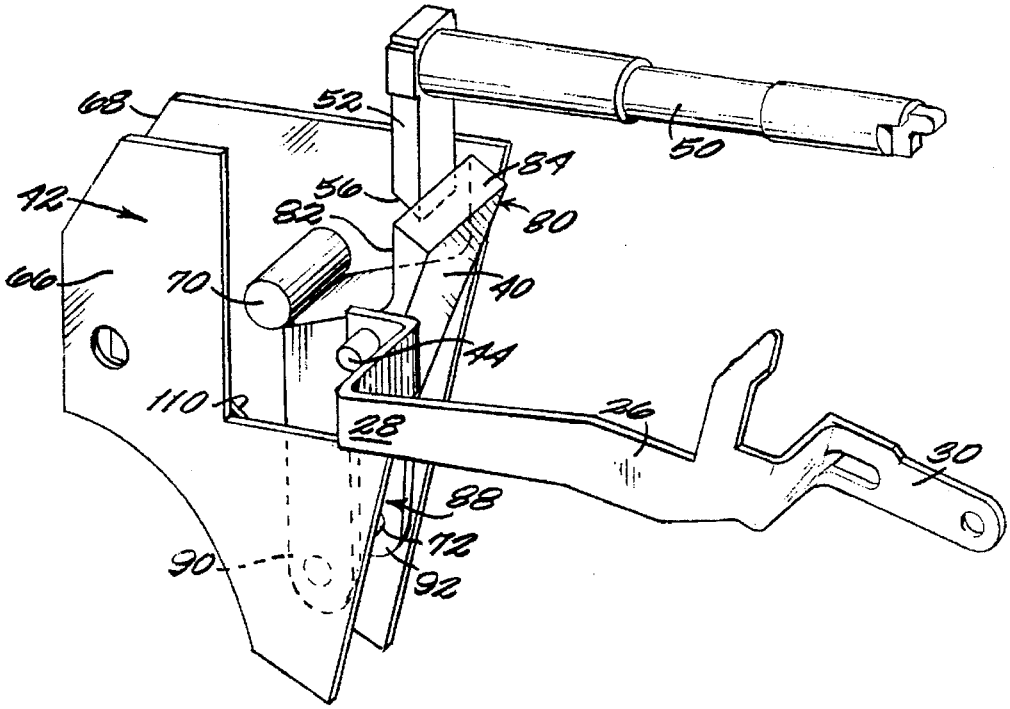
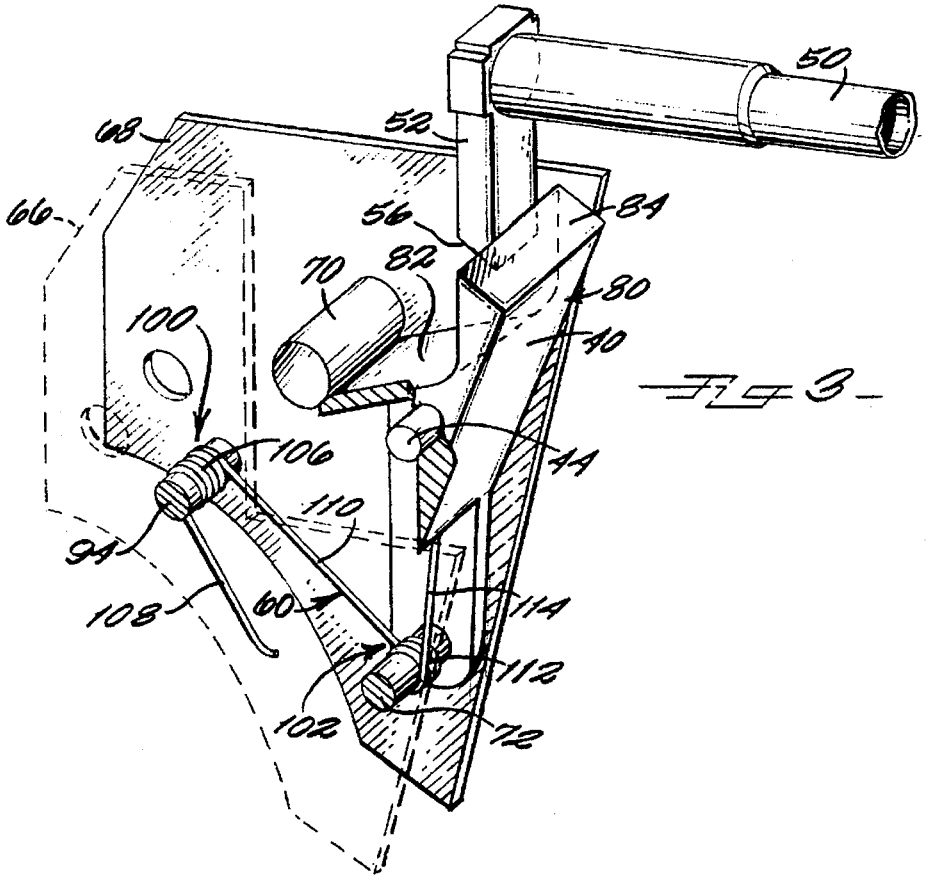
FIG 3

FIRE CONTROL MECHANISM FOR AN AUTOMATIC PISTOL

BACKGROUND OF THE INVENTION

1. Field of the Invention

The present invention relates to semiautomatic pistols and, in particular, to fire control mechanisms for semiautomatic, double-action only pistols.

2. Discussion of Background

Semiautomatic pistols have been manufactured and used for decades. Improvements in semiautomatic pistols have increased their sophistication and effectiveness. Generally, these pistols are preferred by military and law enforcement personnel in the line of duty where a pistol must be accurate, reliable and safe to use. A pistol must be able to hit the target it is aimed at, to fire rounds repeatedly without jamming, and to fire only when the user intends to fire the pistol. Beyond these three basic concerns, a pistol should also be durable, have good balance, be easy to operate and service, be simple and inexpensive to manufacture, and have consistent, reasonable trigger-pull characteristics.

A semiautomatic pistol captures and utilizes part of the energy released from the firing of one round to load the next round into the firing chamber. Usually, the energy taken up by the recoil of a slide is used to push the next of a series of rounds into the firing chamber. The slide is part of one of a pistol's component groups that includes the barrel and breech block. In addition to the slide, a semiautomatic pistol has other component groups. There is the frame that includes the handle and trigger guard. The handle may be hollow in order to receive a clip containing a number of rounds of ammunition. The rounds are fed one at a time into the breach block. Finally, there is the fire control system which includes the trigger, the trigger bar, the sear, the striker, and the striker spring. Some fire control systems include a hammer as part of the fire control group.

Typically, the trigger is connected to the sear through the trigger arm. In pistols without hammers, pulling on the trigger between a forward and a rearward position causes the sear to release the striker, which is loaded against the striker spring, whereupon the striker is propelled forward toward the chambered round. The firing pin on the end of the striker strikes the primer on the shell casing of the chambered round, causing it to detonate. In pistols with hammers, pulling on the trigger causes the sear to release the hammer, which is loaded by a spring, whereupon the hammer pivots forward, hitting the striker and driving it toward the round in the chamber.

When the round detonates, chemical energy of the gun powder in the shell is converted to kinetic energy of the bullet, and the bullet is propelled from the casing through the barrel and out the muzzle of the pistol. The forward momentum of the propelled bullet is equaled by the rearward momentum of the pistol, which is partially absorbed as recoil of the slide. That recoil is controlled by a spring that returns the slide to its pre-fired position. The recoil of the slide, including its complete motion rearward and forward following the firing of the pistol, is used to eject the bullet's now empty shell casing and to chamber a next round. It may also be used to cock or partially cock the striker in some semiautomatic pistols.

Some semiautomatic pistols are described as being "single action," meaning that the trigger pull only releases the striker, the recoil having been used to cock the striker. Other semiautomatics are "double action," meaning that the trigger pull cocks, or at least partially cocks, the striker and also releases the striker after it is fully cocked. Some double action pistols are not truly double action because the recoiling slide partially cocks the striker. In true double action, the recoiling slide does not cock the striker, so there is no loss of momentum of the slide as is the case with those pistols that are not true double action. A pistol that is double action has only one mode: one where pulling the trigger cocks the striker; the recoil of the slide, other than removing the spent shell casing and chambering the next round, serves only to take up the recoil of the pistol.

The relationship of the various parts of a fire control system have been the subject of considerable development. U.S. Pat. No. 5,386,659 issued to Vaid, et al. teaches a design for a semiautomatic, double-action pistol. Their pistol design includes a sear biased forward by a sear spring which must be tensioned along with the compression of the striker spring to cock the striker. On recoil after firing, the sear and striker move in parallel planes so that they are fully repositioned for the next firing cycle. Three interrelated patents issued to Glock: U.S. Pat. Nos 4,539,889, 4,825,744, and 4,893,546, describe a fire control system for an automatic pistol where the pistol is partially cocked on recoil. Pulling the trigger moves the striker rearward against the striker spring and through a critical position on the travel path of the striker to complete the cocking. Two springs are used to establish a cocking force: a stronger spring that will urge the striker forward for firing and a weaker spring urging it rearward in order to substantially reduce trigger force.

Other designs for pistols exist. However, there remains a need for an effective fire control system for a semiautomatic pistol that operates reliably and safely.

SUMMARY OF THE INVENTION

The present invention is a fire control system for a semiautomatic pistol. The pistol is double-action only, that is, pulling on the trigger both cocks the firing pin and releases it. In particular, the invention is a fire control system that includes a "floating" sear. The sear is said to be floating (although it is not literally floating) because it is not attached directly to the frame. Rather, it is supported primarily by the free end of a cantilevered spring means that is carried by the frame. The spring means has a spring on each end: a spring on one end for cantilevering the spring means so that the sear, carried by the distal end of the spring means, is urged upward but can move downwards; the other spring urges the sear forward but it can move backwards. Thus, the spring means provides the sear with movement in two directions, up and down, and forward and backward, where the movement in one direction is substantially independent of the movement in the other direction. This independent, two-directional movement is important in the operation of the sear. The trigger pull moves the sear rearwards, to load the striker, while at the same time the sear moves downwards, to release the striker. Motion of the sear in these two directions compresses the cantilevered spring means so that it not only permits the rearward and downward movement of the sear but also restores the sear to its original upward and forward position for the next firing cycle.

The cantilevered spring, in a preferred embodiment, is a spring system with each end formed into a torsion spring separated by a length of wire that also acts like a spring. The cantilevered spring thus has two biasing actions, each action provided by the main body of the spring in combination with one of the torsion springs. Each biasing action operates substantially independently on the sear. The sear is attached to the free end of the cantilevered spring; the other end of the spring is secured to the frame so that the main body of the spring is cantilevered.

The torsion spring on the first end of the cantilevered spring lifts the main body and thus cantilevers the main body of the spring so that it resists downward motion by the sear. The torsion spring on the second end of the spring holds the sear away from the upper side of the main body of the spring so that the sear is urged forward.

The sear of the present invention has two cam surfaces. The first cam surface of the sear operates against a cam surface of the sear block to guide the sear along its rearward and downward path when the trigger is pulled. The sear's second cam surface engages the striker after the striker moves forward. As the trigger is released, the sear moves forward. When the sear's second cam surface engages the striker leg, the sear is cammed down slightly. After clearing the striker leg, the sear moves up. Then, positioned forward of the striker, the sear can again load the striker when the trigger is pulled. This second cam surface enables the sear to lay in the same plane as the striker leg and yet return to a position forward of the striker leg on release of the trigger to set up for the next firing cycle.

The sear floating on a cantilevered spring means is an important feature of the present invention. This combination makes the rearward motion of the sear substantially independent of its downward motion but provides a smooth transition from one to the other. It also provides a greater range of rearward motion of the sear in relation to its downward motion, so that the sear can fully load the striker. Finally, it biases the sear to its original position so that it will return for the next firing cycle.

The use of a cantilevered spring with torsion springs formed in each end as the spring means is another feature of the present invention. In this form, one part does two jobs. The spring keeps the sear in position with respect to the striker during the pulling of the trigger and restores it for the next firing cycle. Furthermore, by modifying the shape, angles, thickness and number of coils of the torsion springs, the spring characteristics of this part can be adjusted easily to meet these three tasks.

The floating sear is another feature of the present invention. By having the sear float, it does not add appreciably to the forces resisting trigger pull but it does add to the range of motion possible with the sear.

The second cam surface is a feature of the present invention. This second surface enables the sear to be repositioned for the next firing cycle without having to recoil the slide.

Other features and advantages will be apparent to those skilled in the art from a careful reading of the Detailed Description of Preferred Embodiments accompanied by the following drawings.

BRIEF DESCRIPTION OF THE DRAWINGS

In the drawings,

FIG. 2 illustrates a perspective view of the fire control mechanism according to a preferred embodiment of the present invention;

FIG. 3 is a slightly larger perspective view than that shown in FIG. 2 with the front wall of the sear block and trigger arm removed to show the cantilevered spring according to a preferred embodiment of the present invention.

DETAILED DESCRIPTION OF PREFERRED EMBODIMENTS

Figure 1:
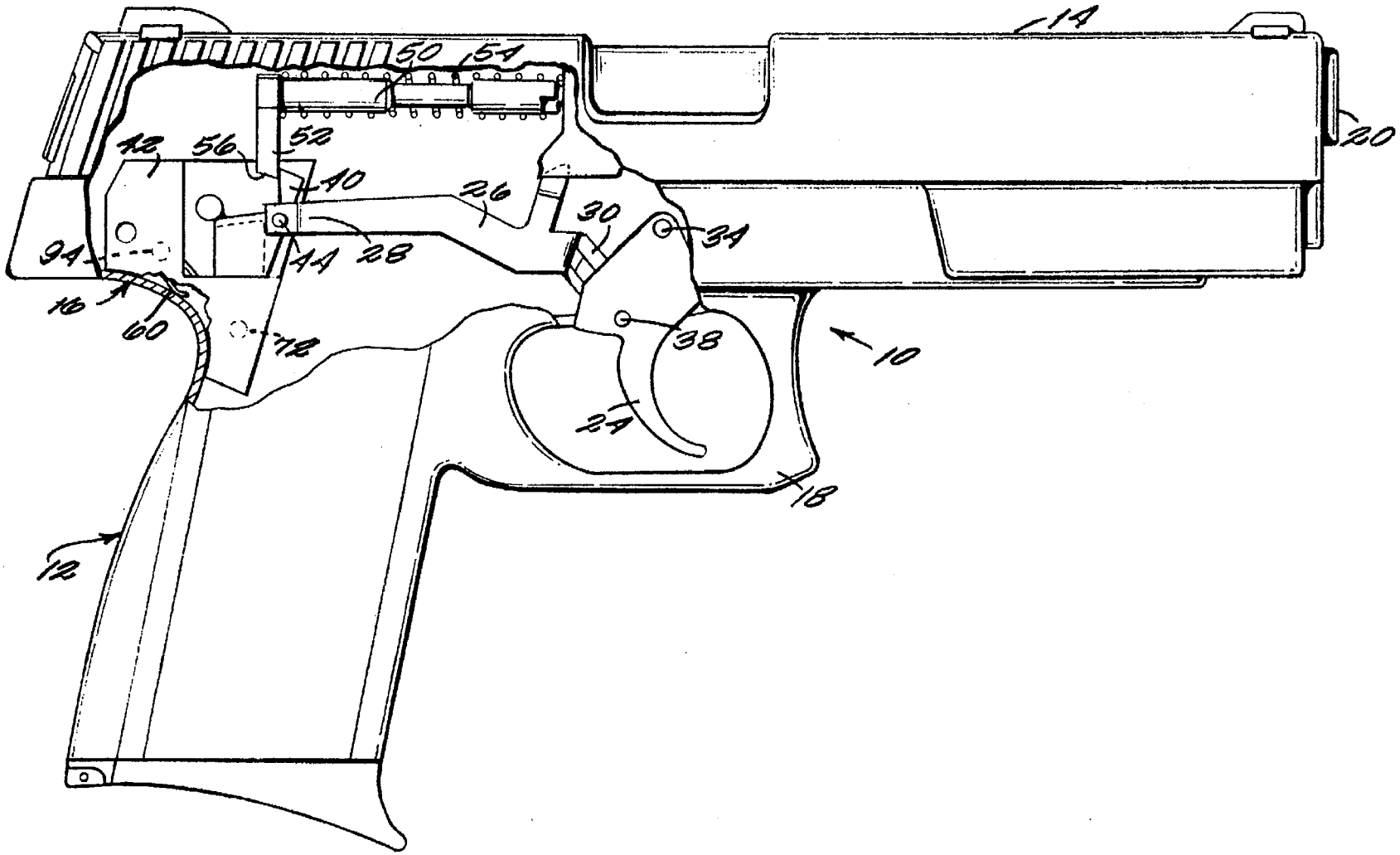
FIG. 1 illustrates a side view of a pistol with a portion cut away to reveal a fire control mechanism according to a preferred embodiment of the present invention.

The present invention is a fire control system for a semiautomatic, double action only pistol, or any weapon having a striker and a striker spring. Referring now to FIG. 1, there is illustrated a pistol according to a preferred embodiment of the present invention and generally indicated by the reference numeral 10. Pistol 10 has a handle 12, a slide 14 slidably mounted to frame 16 in a conventional manner. Frame 16 includes a trigger guard 18. At the front of pistol 10 is a muzzle 20.

For convenient reference, the term "forward" will be used to mean a direction toward muzzle 20 and rearward will mean a direction opposite muzzle 20.

FIG. 1 is partially cut away to show a fire control mechanism according to the present invention that includes a trigger 24, a trigger arm 26 having a first end 28 and a second end 30. Second end 30 is pivotally connected to trigger 24 by a pivot pin 38 and to a sear 40 in sear block 42 that has a pivot pin 44 inserted into a hole on first end 28. The fire control mechanism also includes a striker 50 with a depending striker leg 52. As will be explained more fully below, sear 40 is supported by a spring 60.

In general, a firing cycle is the complete action of pulling on trigger 24 beginning when it is in its most forward position and continuing until it, acting through the balance of the fire control mechanism, fires the round in the chamber, and then continuing through the release of trigger 24 to its most forward position. When trigger 24 is squeezed, it pivots about a trigger pivot pin 34 against a trigger spring (not shown) and pushes trigger arm 26 rearward. When trigger 24 is released, it pulls trigger arm 26 forward. Trigger arm 26 links trigger 24 at second end 30 with sear 40 at first end 28. Therefore, squeezing and releasing trigger 24 moves sear 40 rearward and forward, respectively. The rearward movement of sear 40 loads striker 50 when sear 40 engages striker leg 52 and pushes it rearward against striker spring 54.

Referring now to FIGS. 2 and 3, there are illustrated details of the fire control mechanism in perspective. Sear block 42 includes a front plate 66 connected to a rear plate 68. Attached to rear plate 68 is a cam surface 70 with a major axis perpendicular to the plane of rear plate 68. Sear 40 has an upper portion 80 with a first surface 82 that cams against cam surface 70 and engages striker leg 52, and a second surface 84 that cams against striker leg 52, and sear 40 has a lower portion 88 with a front leg 90 and a rear leg 92 that straddle a first spring pin 72. No part of sear 40 is connected to sear block 42 or frame 16 (FIG. 1). First spring pin 72 is not connected to front and rear plates 66, 68, only to front leg 90 and rear leg 92; rather, first spring pin 72 "floats" with sear 40. Sear 40 engages striker leg 52, cylinder 70, and first end 28 of trigger arm 26 which rides on pivot pin 44, but there is no attachment of these components to each other. Connected to front and rear plates 66, 68, is a second spring pin 94. Sear 40 is supported by frame 16 and sear block 42 only through spring 60 and second spring pin 94.

Spring 60, as seen most clearly in FIG. 3, provides the connection between frame 16 and sear block 42, which are rigid, and sear 40, which is described herein as floating because it itself is not rigidly attached or constrained in the two directions of motion by any part of the frame or sear block. Sear 40 is clearly constrained from moving side to side by front and back plates 66 and 68; however, side to side motion is not important in the firing cycle. Only forward and rearward, upward and downward motion is important in the firing cycle. Sear 40 is not constrained in these directions by sear block 42 or frame 16.

Sear 40 is cantilevered by spring 60 in such as way that it can move in two different directions independently, namely, horizontally and vertically. In other words, spring 60—which is a spring system, as will be explained—permits motion of sear 40 in these two directions and does so in such a way that the motion in each direction is independent. This characteristic movement is achieved by making spring 60 a double-coiled spring where the coils provide spring biasing on each end. The two coils are connected by a length of wire that in itself acts as a spring and smoothes the transition from horizontal to vertical movement.

Spring 60 has a first end 100 coiled about second spring pin 94, and a second end 102 coiled about first spring pin 72. First end 100 has first coil 106 that biases a flame-engaging portion 108 away from a center portion 110; second end 102 has a second coil 112 that biases center portion 110 from a sear-engaging portion 114 of spring 60. Both first and second coils, 106 and 112, are torsion springs and are made of the same metal or metal alloy wire that comprises the balance of spring 60. By changing the thickness, the number of coils, the length, and the metal characteristics of this spring, its spring constants can be changed to deliver the desired amounts of spring biasing at each end of spring 60.

It will be clear from FIG. 3 that first coil 106 urges second coil 112, and therefore sear 40, in an upward direction because center portion 110 is lifted by the bias given by first coil 106 to frame-engaging portion 108 against rigid frame 16. Because frame-engaging portion 108 cannot move down against frame 16 and has no forces on it to move it up, center portion 110 will have substantially the full benefit of the spring forces of first coil 106 and will be loaded by downward movement of sear 40.

Likewise, it will be clear that second coil 112 urges sear 40 forward (toward muzzle 20) and resists rearward loading as sear-engaging portion 114 is biased away from center portion 110 by second coil 112. Sear engaging portion 114 is limited in its forward motion, and therefore sear 40 is limited in its forward motion, by first coil 106, because it is biased against being uncoiled as it is against being coiled.

The downward movement of sear 40 is governed by two cam surfaces. Cylinder 70 moves sear 40 downward as trigger arm 26 pushes pivot pin 44 of sear 40 rearward, in turn pushing first surface 82 of upper portion 80 of sear 40 rearward against cylinder 70. After sear 40 is moved downwards a sufficient amount (in a preferred embodiment, 0.060 inches) by camming against cylinder 70, first surface 82 of upper portion 80 slips off striker leg 52, thus releasing striker 50, loaded by striker spring 54, to strike the primer of the loaded shell (not shown). Striker 50 is then located forward of upper portion of sear 40 and cannot be loaded against striker spring 54. However, as trigger 24 is released, it pulls trigger arm 26 and thus sear 40 forward. When second surface 84 of upper portion 80 of sear 40 meets angled surface 56 of striker leg 52—sear 40 moving forward with respect to striker leg 52—upper portion 80 is cammed down a second time in the firing cycle. The first downward camming of sear 40 occurs when sear is moved rearward against cylinder 70; the second downward camming occurs when sear 40 is moved forward against angled surface 56 of striker leg 52. When trigger is fully released, striker leg 52 is again located rearward of sear 40, which is urged upward and forward by spring 60, and striker 50 is ready to be loaded by sear 40 against striker spring 54 when trigger 24 is pulled.

Figure 5:
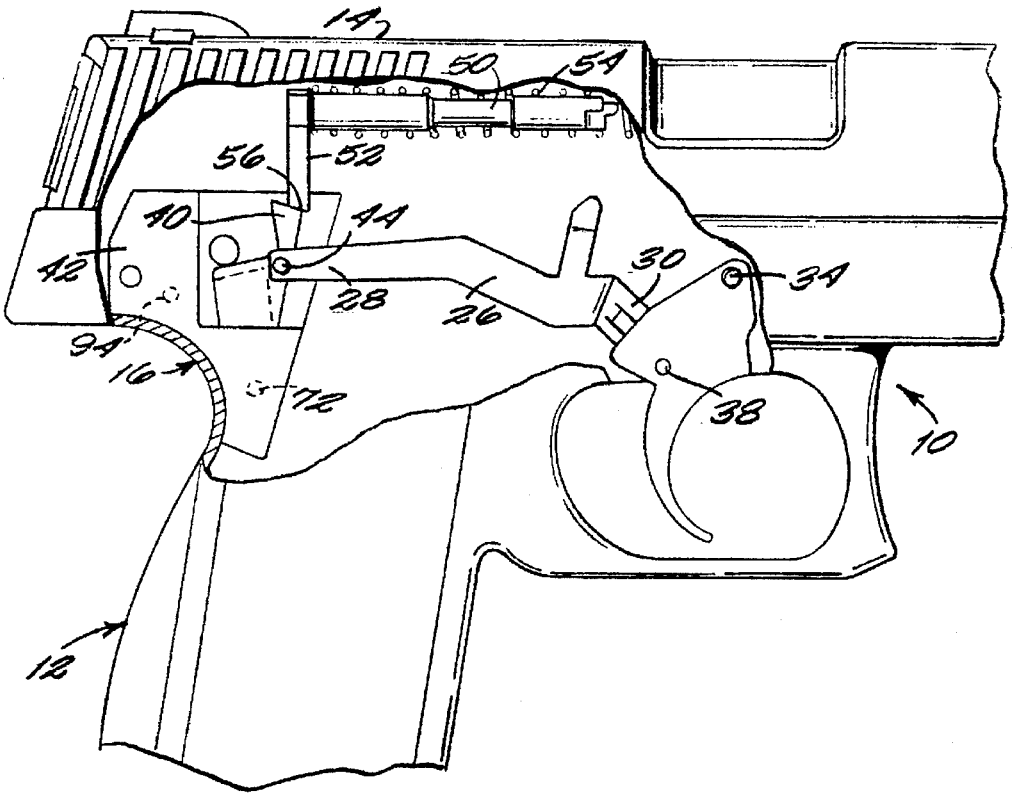
FIGS. 4 and 5 show a sequence of side views of a portion of a pistol in each stage of operation of a preferred embodiment of the fire control mechanism of the present invention.
Figure 4:
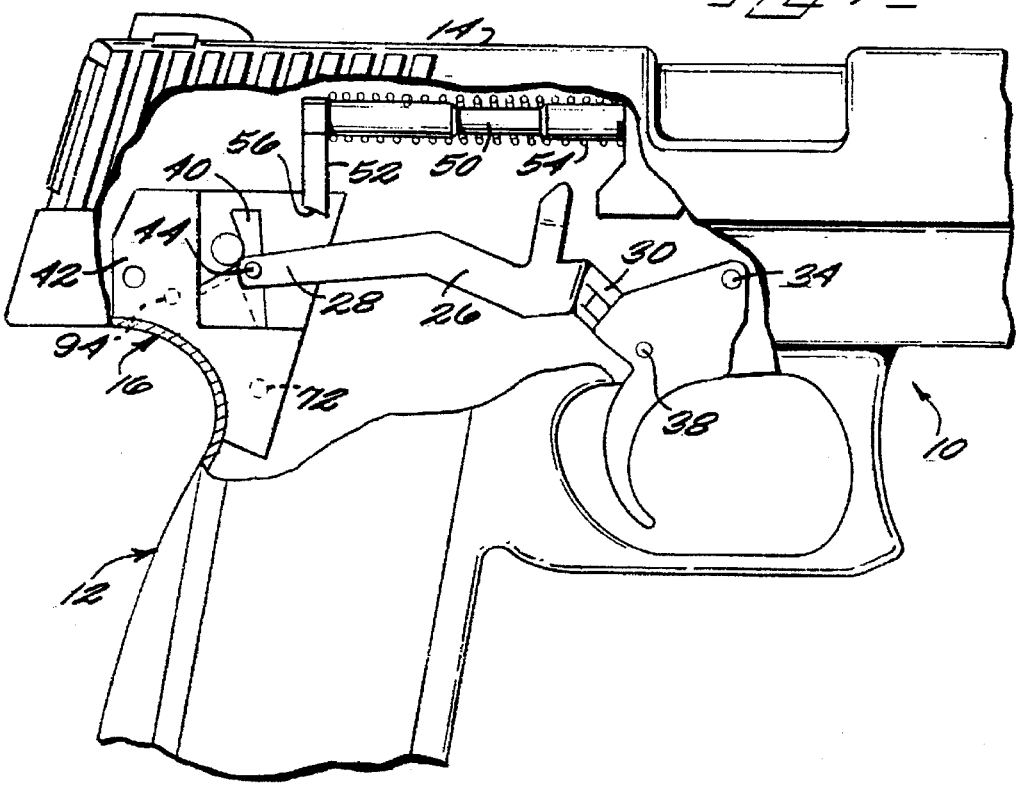

This sequence is best seen in FIGS. 1, 4 and 5. Beginning in FIG. 1, trigger 24 begins its travel from a first position, namely, the most forward position in the firing cycle. Trigger 24 pivots about trigger pivot pin 34 and pushes trigger arm 26 rearward. Trigger arm 26 in turn pushes sear 40 rearward. First surface 82 of upper portion 80 of sear 40 engages cylinder 70 which pushes sear 40 down, slowly at first and then slightly more rapidly at the very end of the first part of the cycle. In moving rearward, sear 40 is moving against first coil 106 at first end 100 of spring 60; in moving downward, sear 40 is moving against second coil 112 at second end 102 of spring 60. Both coil 106 and 112 are tightening against the movement of sear 40.

FIG. 4 shows that trigger 24 is in its second position, namely, its most rearward position, and sear 40 has completed its rearward and downward movement and striker leg 52 has been released when first surface 82 of upper portion 80 of sear 40 has moved downward sufficiently. Striker 50 has been propelled forward, relieving the forces of striker spring 54 and is now forward of sear 40. The round in the chamber (not shown) has been fired and slide 14 has recoiled in the usual manner.

FIG. 5 shows that trigger 24 has been released and urged forward so that it pivots about trigger pivot pin 34. Trigger 24 pulls trigger arm 26 and, with it, sear 40. Sear 40, in its forward movement, meets striker leg 52. Angled surface 56 of striker leg 52 cams second surface 84 of upper portion 80 of sear, pushing it downward the second time in the firing cycle. As soon as sear 40 clears striker leg 52, it is free to move upward at the continuous urging of spring 60. Once forward of striker leg 52, sear 40 is again in position to load striker when the trigger is pulled.

To fire a chambered round, the user of a pistol according to the present invention need only pull the trigger; to prepare the pistol for a subsequent firing, the user need only release the trigger. The pistol cannot fire the second round unless the trigger is released. Also, the pistol is not partially cocked simply by the recoiling of the slide; the movement of the slide does not cock or partially cock the striker.

Although in the preferred embodiment described above, spring 60 is a single piece of wire that is formed to have a coil on each end, it will be clear to those skilled in making springs that other types of springs and other arrangements will be equivalent, including a compound leaf spring and multiple, separate springs, for example. Furthermore, it will be clear to those skilled in the art that many other changes and substitutions can be made to the preferred embodiments described herein without departing from the spirit and scope of the present invention, which is defined by the appended claims.

What is claimed is:

1. A fire control system for a semiautomatic weapon, said semiautomatic weapon having a frame, a striker carried by said frame and a striker spring biasing said striker in a forward direction, said system comprising:

a trigger;

a trigger arm having a first end and an opposing second end, said trigger connected to said second end;

a sear engaging said first end of said trigger arm; and first spring means for urging said sear in said forward direction, said first spring means providing primary support for said sear;

second spring means for urging said sear in an upward direction, said second spring means providing primary support for said first spring means.

2. The system as recited in claim 1, wherein said second spring means has a first end attached to said frame and an opposing second end on which said first spring means is carried, said second end being cantilevered from said frame by said first end.

3. The system as recited in claim 1, wherein said second spring means has a first end attached to said frame and an opposing second end on which said first spring means is carried, said second end being cantilevered from said frame by said first end, said sear carried by said first spring means on said cantilevered second end of said second spring means.

4. The system as recited in claim 1, wherein said first and said second spring means are in the form of a spring system having a first end and an opposing second end, said first spring means being a first torsion spring carried by said second end of said spring system and said second spring means being a second torsion spring carried by said first end of said spring system, said sear carried by said first torsion spring.

5. The system as recited in claim 1, wherein said sear carries means for enabling said striker to urge said sear downward against said second spring means when said sear is moving in said forward direction.

6. The system as recited in claim 1, wherein said sear has a cam surface, said striker urging said sear downward against said second spring means when said cam surface of said sear engages said striker and said sear is moving in said forward direction.

7. The system as recited in claim 1, wherein said first spring means is positioned to be loaded by rearward movement of said sear and said second spring means is positioned to be loaded by movement of said sear downward, said second spring means being loadable essentially independently of said first spring means.

8. A fire control system for a semiautomatic weapon, said semiautomatic weapon having a frame, a slide carried by said frame, a striker carried by said slide, and a striker spring biasing said striker in a forward direction, said system comprising:

a trigger;

a trigger arm having a first end and a second end, said trigger connected to said second end;

a sear said sear engaging said first end of said trigger arm;

a first torsion spring, said first torsion spring urging said sear in an upward direction; and a second torsion spring supported by said first torsion spring, said second torsion spring urging said sear in a forward direction, said second torsion spring providing primary support for said sear.

9. The system as recited in claim 8, wherein said sear has a cam surface, said striker urging said sear downward against said first torsion spring when said cam surface of said sear engages said striker and said sear is moving in said forward direction.

10. The system as recited in claim 8, wherein said first torsion spring has a first end and an opposing second end, said first end engaging said frame so that said second end is cantilevered.

11. The system as recited in claim 8, wherein said first torsion spring and said second torsion spring are connected by a center portion.

12. The system as recited in claim 8 further comprising a sear block; and wherein said sear is supported within said sear block by said first and second torsion springs, so that said sear is not connected to the frame and is not connected to said sear block.

13. A weapon for firing a bullet, said weapon comprising:

a frame;

a slide slidably mounted to said frame;

a striker carried by said slide;

a striker spring urging said striker forward;

a trigger carried by said frame so that said trigger can move between a first position and a second position;

a trigger arm having a first end and an opposing second end, said trigger attached to said second end of said trigger arm;

a sear in operative connection with said first end of said trigger arm so that said trigger arm can move said sear rearward and downward when said trigger is moved from said first position to said second position; and a member having a first end and an opposing second end, said first end carrying a first spring, said second end carrying a second spring, said first spring urging said sear upwards and said second spring urging said sear forward, said second spring providing primary support for said sear, said sear engaging said striker when said trigger moves said trigger arm rearward so that said striker spring loads said striker, said sear releasing said striker when said striker is sufficiently loaded by said striker spring so that said striker has sufficient potential energy to fire said bullet.

14. The weapon as recited in claim 13 wherein said first end engages said frame so that said second end is cantilevered.

15. The weapon as recited in claim 13 wherein said first end is held by said frame so that said second end is cantilevered, said sear carried at said second end.

16. The weapon as recited in claim 13 wherein said first spring and said second spring are torsion springs.

17. The system as recited in claim 13 wherein said first spring and said second spring are torsion springs, said first spring biased against said frame to cantilever said member.

* * * * *